United States Patent [19]

Kartmann

[11] 4,307,564

[45] Dec. 29, 1981

[54] SPINDLE FOR SPINNING AND/OR TWISTING ON RING SPINNING- AND/OR RING TWISTING-MACHINES WITH REDUCED BALLOON THREAD

[75] Inventor: Siegfried Kartmann, Lechbruck, Fed. Rep. of Germany

[73] Assignee: SIKA Siegfried Kartmann GmbH, Allgaü, Fed. Rep. of Germany

[21] Appl. No.: 114,626

[22] Filed: Jan. 23, 1980

[30] Foreign Application Priority Data

Feb. 2, 1979 [DE] Fed. Rep. of Germany ..... 2904015
Aug. 31, 1979 [DE] Fed. Rep. of Germany ..... 2935276

[51] Int. Cl.³ ..... D01H 7/18
[52] U.S. Cl. ..... 57/73
[58] Field of Search ..... 57/66, 72–74, 57/352, 353

[56] References Cited

U.S. PATENT DOCUMENTS

| | | | |
|---|---|---|---|
| 2,622,388 | 12/1952 | Roeder | 57/73 |
| 3,032,960 | 5/1962 | Kartmann | 57/73 |
| 3,104,514 | 9/1963 | Schloesser | 57/73 |
| 3,726,076 | 4/1973 | Wurmli | 57/73 |

FOREIGN PATENT DOCUMENTS

| | | | |
|---|---|---|---|
| 792862 | 10/1935 | France | 57/73 |
| 1417882 | 10/1965 | France | 57/73 |
| 921117 | 3/1963 | United Kingdom | 57/73 |
| 930694 | 7/1963 | United Kingdom | 57/73 |
| 993058 | 5/1965 | United Kingdom | 57/73 |
| 1034456 | 6/1966 | United Kingdom | 57/73 |

*Primary Examiner*—John Petrakes
*Attorney, Agent, or Firm*—St. Onge, Steward, Johnston, Reens & Noe

[57] ABSTRACT

Spindle for the spinning or twisting of threads on ring spinning and/or ring twisting machines providing reduced thread ballooning with a spindle head seated on the spindle shaft, said head picking up the thread upon rotation thereof via thread catchers situated on said head, wherein the thread catchers basically consist of outwardly positioned vertical, cylindrical pins which are connected to an inwards positioned cylindrical body via a radial connecting piece and the thread catchers at least partly project over the central body, wherein the highest point of the thread catcher lies between the central body and the periphery of the spindle head.

7 Claims, 4 Drawing Figures

SPINDLE FOR SPINNING AND/OR TWISTING ON RING SPINNING- AND/OR RING TWISTING-MACHINES WITH REDUCED BALLOON THREAD

BACKGROUND OF THE INVENTION

The invention relates to a spindle for the spinning or twisting of threads on a ring spinning and/or ring twisting machine to provide reduced thread ballooning, with a spindle head seated on the spindle shaft, said head having thread catchers picking up the thread upon the rotation thereof said thread slipping over the thread catchers and said catchers projecting over the rotation body circumscribed by the thread running over the spindle head, and possibly with a downwards tapered conical body situated beneath said rotation body.

After it was found possible to spin or twist on ring spinning or ring twisting machines "balloon-free" or better said, with reduced thread ballooning, there was an abundance of suggestions made for improving this method, as it provided considerable advantages.

The main problem when spinning or twisting, lies in close connection with the thread tension and thread tension deviations or rather the place where the thread tensions occur. They put limits to the increase in performance of the common ring spinning and twisting machines, said performance hardly having increased at all in recent times, at least not to an extent in which the machines could operate with a better output.

With these problems, the question of quality of the obtained product is also closely connected.

Spindles with specially formed heads or thread guides mountable on the spindle have already been suggested, through which the conditions during spinning and twisting are supposedly improved with or without thread ballooning, especially in connection with the thread tension between the delivery cylinder and the head.

Spindles with spindle heads for ring spinning and twisting machines are known with which the thread is guided in a helical form over the spindle head using groups of catchers of various design arranged on the spindle head. The catchers are of e.g. prismatic or conical shaped or pyramid-like or similar projections which are arranged in varying ways on the spindle head. Here the spindle head is usually so formed that the thread coming from the thread guiding eye runs onto suitably formed surfaces of the spindle head with as little disturbance as possible and at a tangent, said surfaces being formed in as rounded-off a form as possible, so that the course of thread is disturbed as little as possible. As these known projections on the spindle head have the task of catching up the thread, they are formed in connection with this task and are called catchers, as they are to prevent the thread from flying off the spindle head and forming a balloon.

It has furthermore already been suggested in the inventor's own prior U.S. Pat. No. 3,032,960 to use a spindle head consisting of a basically cylindrical body over which the thread coming from the thread guide is led and which has groove-like slots in the outer casing as its main feature (see also the inventor's corresponding DE-PS's Nos. 11 16 584 and 12 86 438). The groove-like slots arranged in the cylindrical body of the spindle head extend upwards to the end surface of the head and end down in the cylindrical case surface below which a downwards tapered cone-casing surface is situated.

It has proved however, after the above mentioned spindleheads, especially those according to the DE-PS's Nos. 11 16 584 and 12 86 438, have been used in great numbers for many years, that they still have room for improvement despite all the expectations put to them which have basically been fulfilled, this improvement being in connection in particular with the quality of the obtained threads.

SUMMARY OF THE INVENTION

The invention is based on the task of further improving the spindle heads of the known type in question in order to avoid the mentioned disadvantages and to ensure as fault-free a spinning or twisting operation as possible which gives perfect, high quality and even products, even with effect yarns.

It is known that when spinning with selfactors, the obtained thread has an extremely good evenness which is due to the fact that the thread is set into transversal oscillations when the carriage is run out, due to the rotating spindle and the thread jumping over or rolling over the spindle head or sleeve head, and thus achieving a better orientation and arrangement of the fibers in the thread right at the beginning of its turning, which results in an improvement in quality of the thread.

With this acknowledgement, the specific task of the invention lies in creating at least similar conditions to those with selfactor spinning, especially for ring spinning. After extensive experiments for solving the aforementioned task, the surprising result was found that considerable improvement over the known spindle heads could be achieved if, taking approximately a spindle head according to the DE-PS No. 11 16 584 or DE-PS No. 12 86 438 as a basis, these heads are formed in such a way that the catchers consist of pins of a basically vertical cylindrical shape with a rounded top end, which are connected to a central cylindrical body via a radial connecting piece, that the catchers project above the central body and that the top edge of the radial connecting piece lies on the connection line from the top end surface of the central body to the highest point of the catcher.

It was confirmed, during experiments over a sufficiently estimated time period for the purpose of assurance of the obtained results, that when spinning or twisting with spindles equipped with spindle heads according to the invention, the thread runs with a slight vibration whilst the thread tension remains unaltered in a favourable range, wherein a better fiber arrangement and fiber density is achieved in the critical area and a thread can be obtained which is considerably more even than was hitherto the case. It could also be confirmed that the twist of the thread has become more even and better.

Experiments have however now shown that with certain threads, especially those which are difficult to spin or twist, the aforementioned spindle head can be further improved in order to ensure a smooth operation with low rate of defect.

In a further embodiment of the subject matter of the invention, it is suggested to form the spindle head for the spindles in question, in such a way that the top edge of the radial connecting piece climbs from the center of the top end surface of the central cylindrical body in an outwards direction to a highest point and then, from this highest point, drops, also in outwards direction, to the top end of the cylindrical pin, wherein the highest point of the top edge of the radial connecting piece lies between the central body and the cylindrical pin.

The FIGS. 1 to 4 show two preferred embodiments of the improved spindle head according to the invention, which are subsequently described in detail.

DETAILED DESCRIPTION OF THE DRAWINGS

Figure 1:
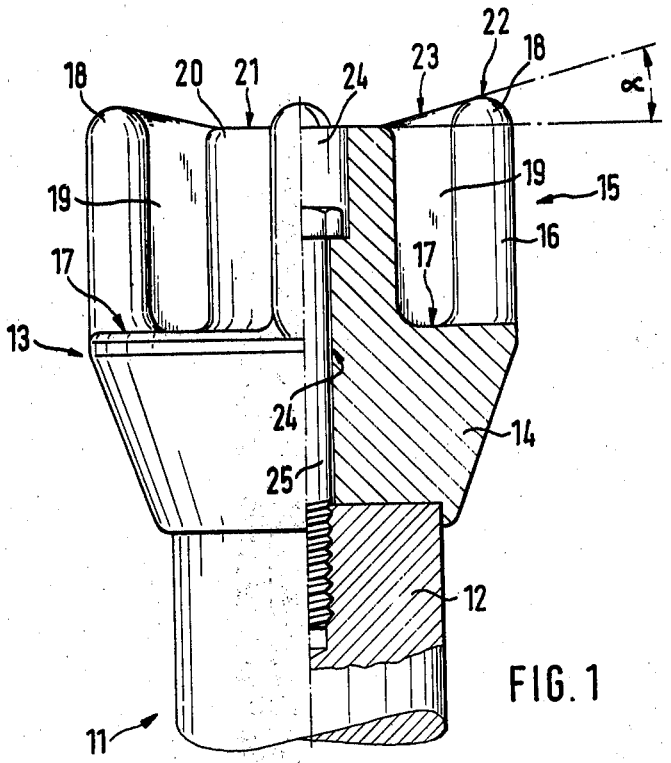
FIG. 1 shows an axial section through the top part of a spindle with spindle head according to the invention, partly shown in section.
Figure 2:
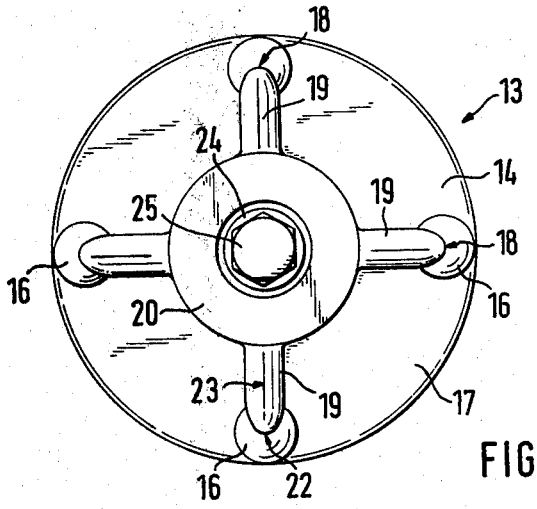
FIG. 2 shows a top view onto the spindle head according to FIG. 1.

As FIGS. 1 and 2 show, on the top or free end 11 of the spindle shaft 12, is seated the spindle head 13, which consists of a lower, frustoconical part 14 and an upper cylindrical head part 15 onto which the thread catchers 16 are arranged. The thread catchers 16 consist of basically vertical, (i.e. axially extending) cylindrical pins which extend upwards from the upper, larger end surface 17 of the lower head part 14, and have a top, smooth, dome-like head end 18. The thread catchers 16 are circumferentially spaced about the head adjacent its periphery and are connected to a central cylindrical body 20 via radial connecting or bridging pieces 19, the top or exposed surface 21 of said central cylindrical body 20 lying axially lower that the highest points 22 of the head ends 18 of the catchers 16. The top or exposed edge 23 of the connecting pieces 19 lies on the connection line between the end surface 21 of the central body 20 and the highest point 22 of the head ends 18 of the catchers 16, and climbs from the inside, in an outwards direction at the angle $\alpha$ relative to a plane perpendicular to the spindle axis. In the spindle head 13 there is an axial bore 24 for taking up the bolt 25 with which the spindle head 13 is fixed onto the spindle shaft.

Figure 3:
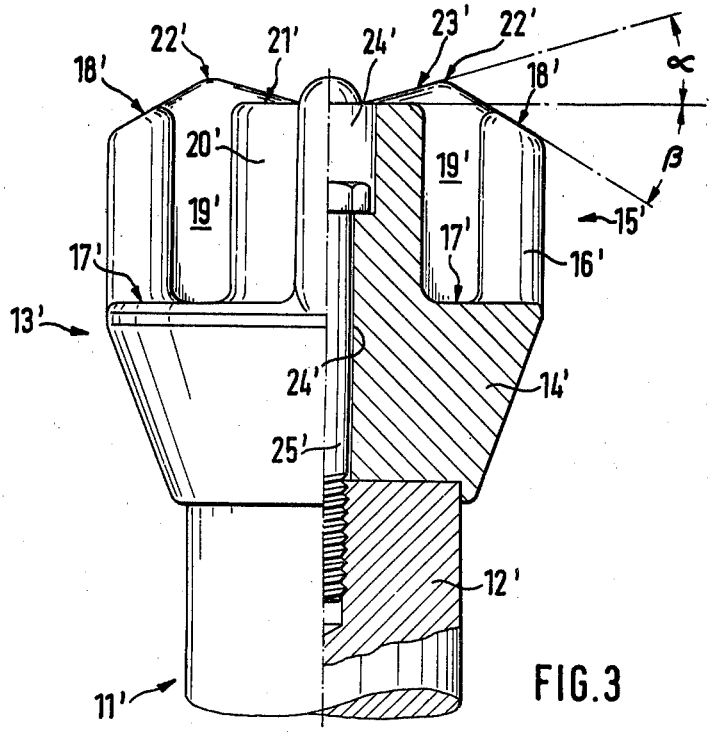
FIG. 3 shows a front view of the top part of a spindle with the further developed, modified spindle head, partly in section.
Figure 4:
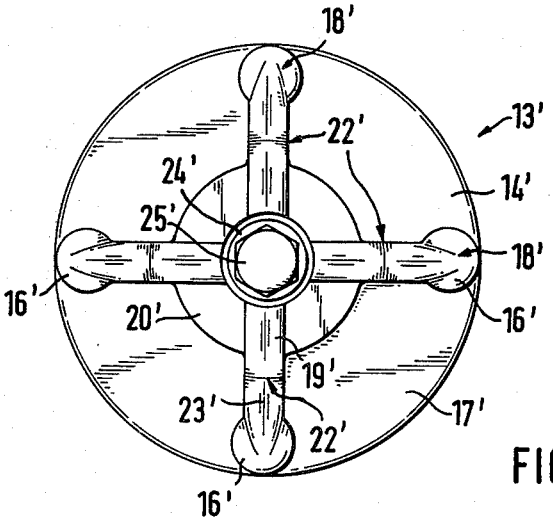
FIG. 4 shows a top view onto the spindle head according to FIG. 3.

As FIGS. 3 and 4 show, in the second embodiment of the invention the spindle head 13' is mounted on the top or free end 11'of the spindle shaft 12', said head consisting of a lower, frustoconical part 14' and an upper head part 15' onto which the thread catchers 16' are arranged. The thread catchers 16' consist of basically vertical, cylindrical pins which extend from the upper, larger end surface 17' of the lower head part 14', in a vertical direction and have a top end 18' which is rounded off. The thread catchers 16' are connected to a central cylindrical body 20' via radial connecting piece members 19' the top (i.e., exposed) surface 21 of said body 20' lying lower than the highest points 22' of the top (i.e., exposed) edges 23' of the connecting piece members 19' which rise from the inner edge of the upper end surface 21' in a radially outwards direction at first angle $\alpha$ reaching the highest point 22' and then fall again in an outwards direction at an angle $\beta$. The highest point 22' of the top edge 23' of the connecting piece member 19' lies between the central body 20' and the peripheral of the head defined by thread catchers 16'. In the spindle head 13' there is situated an axial bore 24' for taking up the bolt 25' with which the spindle head 13' is fixed onto the spindle shaft 12'.

What is claimed is:

1. A spindle for reducing thread ballooning and for maintaining more uniform thread tension during the spinning or twisting of thread on a ring spinning or twisting machine, wherein said spindle comprises;

a spindle shaft adapted to be supported on a ring spinning or twisting machine, and a spindle head on a free end of said spindle shaft;

said spindle head being configured to form thread catcher means at its free end having a plurality of axially extending pins thereat, a central cylindrical body about which said pins are positioned in circumferentially spaced arrangement but radially separated therefrom, and radially directed connecting pieces bridging the gap between respective pins and said central body, wherein the axially endwise exposed surfaces defined by said pins, connecting pieces and central body form point of maximum axial projection lying between said central body and the periphery of said spindle head.

2. A spindle as defined in claim 1, wherein said pins are cylindrical and their free ends are rounded, forming said points of maximum axial projection.

3. A spindle as defined in claim 1, wherein the endwise exposed surfaces of said connecting pieces are configured to define said points of maximum axial porjection.

4. A spindle as defined in claim 1, wherein the axially endwise exposed surfaces of said radially directed connecting pieces rise continuously from said central cylindrical body to said points of maximum axial projection and fall continuously therefrom to the periphery of said spindle head.

5. A spindle as defined in claim 4, wherein the rise of the axially endwise exposed surfaces of said radially directed connecting pieces lies on a straight line running from said points of maximum axial projection to approximately the median diameter of said central cylindrical body.

6. A spindle as define in claim 4, wherein the fall of the axially endwise exposed surfaces of said radially directed connecting pieces terminates at points no higher than the end plane of said central cylindrical body.

7. A spindle as defined in claim 1, wherein said spindle head is larger in diameter than said spindle shaft and has a frustoconical part between said thread catcher means and said shaft.

* * * * *